US010736198B2

(12) United States Patent
Grave et al.

(10) Patent No.: US 10,736,198 B2
(45) Date of Patent: Aug. 4, 2020

(54) CONTROLLING A PLURALITY OF LIGHTING UNITS

(71) Applicant: Lumileds Holding B.V., Schiphol (NL)

(72) Inventors: Manuel Grave, Aachen (DE); Udo Karbowski, Aachen (DE); Nikolai Timm, Aachen (DE)

(73) Assignee: Lumileds Holding B.V., Schiphol (NL)

( * ) Notice: Subject to any disclaimer, the term of this patent is extended or adjusted under 35 U.S.C. 154(b) by 0 days.

(21) Appl. No.: 16/513,406

(22) Filed: Jul. 16, 2019

(65) Prior Publication Data

US 2020/0022240 A1 Jan. 16, 2020

(30) Foreign Application Priority Data

Jul. 16, 2018 (EP) ..... 18183671

(51) Int. Cl.

| | |
|---|---|
| ***H05B 37/00*** | (2006.01) |
| ***H05B 41/00*** | (2006.01) |
| ***H05B 47/185*** | (2020.01) |
| ***H05B 45/10*** | (2020.01) |

(52) U.S. Cl.

CPC ..... *H05B 47/185* (2020.01); *H05B 45/10* (2020.01)

(58) Field of Classification Search

CPC .... H05B 41/34; H05B 33/0803; H05B 39/09; H05B 41/28; H05B 33/0809; H05B 41/295; H05B 41/2827; H05B 41/3925; H05B 33/0815; H05B 33/0818; H05B 41/2828; H05B 41/3921; H05B 41/3927; H05B 37/029; H05B 37/0254; H05B 37/02; Y02B 20/202

See application file for complete search history.

(56) References Cited

U.S. PATENT DOCUMENTS

| | | | | |
|---|---|---|---|---|
| 9,900,963 | B1 | 2/2018 | Doll | |
| 2011/0133655 | A1* | 6/2011 | Recker | H02J 9/02 315/159 |
| 2012/0206050 | A1* | 8/2012 | Spero | B60Q 1/04 315/152 |
| 2012/0313544 | A1 | 12/2012 | Shimomura et al. | |
| 2015/0237700 | A1* | 8/2015 | Woytowitz | H05B 33/0863 315/307 |

FOREIGN PATENT DOCUMENTS

| | | | |
|---|---|---|---|
| WO | 2009156900 | A1 | 12/2009 |
| WO | 2013054221 | A1 | 4/2013 |
| WO | 2014080337 | A2 | 5/2014 |

* cited by examiner

*Primary Examiner* — Minh D A

(74) *Attorney, Agent, or Firm* — Volpe and Koenig, P.C.

(57) ABSTRACT

A lighting system includes a plurality of lighting units. Each lighting unit includes a unit control circuit and a lighting element. The unit control circuit is disposed to store at least one lighting scenario. The lighting scenario comprises a succession of settings of intensity and/or color of the lighting element. A system control circuit is disposed to transmit an execute signal to one or more of the lighting units. The unit control circuit is disposed to control, upon reception of the execute signal, the lighting element according to the lighting scenario. The lighting units are connected to a common electrical power supply via two conductors. The execute signal is transmitted from the system control circuit to the lighting units wirelessly or via the two conductors.

12 Claims, 5 Drawing Sheets

CONTROLLING A PLURALITY OF LIGHTING UNITS

FIELD OF THE INVENTION

The invention relates to a lighting system and a method of operating a lighting system.

BACKGROUND

Lighting systems including a plurality of separate lighting units may be used for different purposes. For example, in an LED lighting strip several lighting units, each including an LED, may be arranged spaced from each other but connected to a common electrical power supply.

WO 2014/080337 A2 discloses a load control system with signal-level based control. In an embodiment of a DC grid lighting system, a grid controller comprises a local microcontroller which performs control so as to alter or change DC output voltage as a signal level of the power supply. A dim level (from an off level to a full-power level) is signalled using only the two power connections of the DC grid to a luminaire. A microcontroller in the luminaire controls a current source to influence the amount of current through light emitting elements based on a translation of a measured voltage level at the power supply input into the control command signalled from the grid controller WO 2009/156900 A1 discloses an illumination system with a plurality of illumination units, each comprising a controller. A central controller gives command signals to the light source units. The system is operated in two operative modes. In a TEACH/LEARN mode the central controller communicates to the controllers of the illumination units data defining color scenarios, and the local controllers store these data into scenario memories. In an EXECUTE mode each local controller operates autonomously to execute the color scenario by reading the scenario data from memory.

WO 2013/054221 A1 discloses a coded lighting system comprising a set of light sources and a remote control. The light sources emit coded light. In order to do so, each light source is associated with a unique identifier. The remote control unit or the arrangement comprises an image sensor which captures images comprising light emitted by at least one of the light sources. By analyzing the captured images, the remote control unit or the arrangement is able to associate light sources affecting a particular region and/or object. The remote control unit or the arrangement is thereby able to transmit a control signal comprising updated light settings to the set of light sources.

In U.S. Pat. No. 9,900,963 B1, an LED controller receives signal modulations from a power line, decodes data based on predetermined modulation characteristics and modifies performance parameters based on operational commands.

US 2012/0313544 A1 discloses LED units arranged in a series configuration with a control unit located at the head of a series which provides both electrical power and control signals down a single wire that allows the LED units to be controlled individually. An LED line driver circuit modulates control data onto the electrical current. In the LED units, an LED controller circuit obtains power from the driver line, stores the power in a supply capacitor and generates the required regulated voltages to power the LED unit. A data signal modulated onto the current is demodulated and decoded to extract a data frame. Commands received in the data frame are executed, driving the LEDs to the specified brightness level.

SUMMARY

It may be considered an object to provide a lighting system and a method of operating a lighting system which allow separate control of individual lighting units or groups of lighting units while maintaining a simple structure.

This object may be addressed by a lighting system according to claim 1 and a method of operating a lighting system according to claim 11. Dependent claims refer to preferred embodiments.

The present inventors have considered that in previous lighting systems where multiple lighting units are connected to a common electrical power supply, a separate data wire is used to control the lighting units individually or in groups to display desired lighting scenarios, e.g. settings for brightness and/or color. Every individually controllable lighting unit or group of lighting units requires a connection to the data line in order to receive commands for the lighting scenario to display. This complicates wiring of the lighting system. In addition, a large amount of data needs to be transmitted to change the lighting scenario for a large number of lighting units, which may result in significant transmission times and risk of transcription errors.

The present inventors have therefore considered to prestore lighting scenarios within control circuits of the lighting units which may be executed upon receipt of an execute signal. This greatly reduces bandwidth requirements and allows a simplified wiring without a separate data line.

According to the invention, a lighting system includes a plurality of lighting units, each including a unit control circuit and a lighting element. The lighting units are preferably arranged spaced from each other and may be arranged e. g. in a line, matrix or other spatial configuration. The unit control circuit may preferably be an integrated circuit such as a microcontroller or microprocessor. The lighting element may preferably include at least one LED element. The term "LED" is understood to include one or more solid state lighting elements of any type, e. g. light emitting diodes, organic light emitting diodes, laser diodes etc.

The lighting element is controllable by the unit control circuit, which means that it may e.g. at least be turned on or off, preferably be controlled to emit light of an intensity and/or color depending on a control signal or power signal supplied by the unit control circuit. Control of intensity may e.g. be effected by time dependent modulation, such as PWM modulation. Color control may e.g. be provided by multicolor LEDs, e.g. multiple LED elements of different color which are separately operable.

The unit control circuit is disposed to store at least one lighting scenario for the lighting element, preferably multiple lighting scenarios. A lighting scenario comprises a succession of settings of intensity and/or color, e. g. including a display time. For example, a lighting scenario may include scenario data describing the lighting element to be operated at a specified intensity and color for a specified duration or flash in different colors in succession.

The lighting system comprises a system control circuit to control operation of the lighting units. The system control circuit may e.g. be a programmable device, which may include a microcontroller or microprocessor. It may transmit an execute signal to one or more of the lighting units. Upon reception of the execute signal, the unit control circuit in the one or more lighting units will control the associated lighting element according to the pre-stored lighting scenario.

While the lighting system is thus able to display complex patterns in succession, the electrical connection may remain simple. The lighting units are electrically connected in parallel to a common electrical power supply via two conductors. Preferably, these two conductors are the only electrical connection of the lighting units to the electrical power supply, and/or to each other. Preferably, there may be no separate data wires provided.

The execute signal is transmitted from the system control circuit to the lighting elements wirelessly or via the two conductors. This is possible because the pre-stored scenario reduces the required bandwidth for control allowing to use wireless transmission or transmission over the electrical power conductors.

In one preferred embodiment, a programing device provides scenario data to one or more of the lighting units. Scenario data may include all information required locally at the unit control circuit to execute a lighting scenario, e. g. at least one setting of intensity and/or colour, preferably multiple successive settings, e. g. with execute times and/or durations. The scenario data is transmitted from the programming device to the lighting unit preferably wirelessly or via the conductors.

The unit control circuit of each lighting unit is disposed to receive and store the scenario data. The scenario data for one or multiple scenarios may be transmitted to each lighting unit once as initial programming, or multiple times as updated programming. This allows for a very flexible handling and does not require initial programming in the lighting units prior to assembly of the lighting system. It should be understood that the term "system control circuit" and "programming device" here refer to different functionalities, but both may for example be realized in the same device or assembly, e. g. programmable computer, microprocessor or microcontroller executing different software for different functions.

In a preferred embodiment, the programming device may transmit a programming signal sequence to one or more of the lighting units. Upon reception of the programming signal sequence, the unit control circuit of the receiving lighting unit receives and stores the following scenario data. The programming signal sequence may be coded to the address of one individual lighting unit to select this lighting unit for storage of the scenario data. Again, the programming signal may preferably be transmitted wirelessly or via the two conductors.

One possible way of transmitting data to one or more of the lighting units is by modulated light. This may be used to transmit the execute signal and/or scenario data. Transmitter means comprise at least one light source disposed to emit modulated light. Within the lighting units, at least one light sensor is arranged, connected to the unit control circuit. The unit control circuit is disposed to process a signal received from the light sensor as it receives the modulated light. The transmit data, e. g. scenario data or execute signal, is decoded from the modulated light in the unit control circuit and processed accordingly. While the light sensor may be a separate component, it is particularly preferred to use at least one LED element which is part of the lighting element as light sensor.

In another embodiment, data may be transmitted by modulated electrical power supplied at the two conductors. The execute signal and/or scenario data may be transmitted by modulating means disposed to modulate the electrical power, e. g. electrical current and/or voltage. The unit control circuit is connected to the two conductors and disposed to receive a modulated electrical signal.

Several different ways of modulation may be employed to transmit data. In one preferred embodiment, modulation may involve supplying the electrical power successively on different voltage levels. Preferably, these include a first voltage level chosen to be sufficiently high for operation of the unit control circuit, but not sufficient for operation of the lighting element. Further preferred, the voltage levels used during modulation may include a second voltage level sufficient for operation of the lighting element. Further, it may be preferred to use a third voltage level lower than the voltage level required for operation of the unit control circuit, which may also be zero.

BRIEF DESCRIPTION OF THE DRAWINGS

These and other aspects of the invention will be apparent from and elucidated with reference to the embodiments described hereinafter.

In the drawings.

DETAILED DESCRIPTION OF THE PREFERRED EMBODIMENTS

Figure 1:
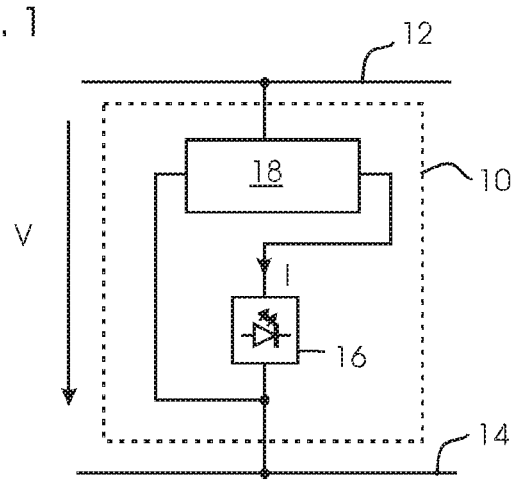
FIG. 1 is a schematic diagram of a lighting unit.

FIG. 1 shows a schematic diagram of a lighting unit 10, which is connected between a first electrical conductor 12 and a second electrical conductor 14. The lighting unit 10 comprises a lighting element 16 and a unit control circuit 18. The lighting element 16 is a multicolor LED comprising individually operable LED elements for red, green and blue light.

The unit control circuit 18 is an integrated circuit including a microcontroller. Unit control circuit 18 further comprises memory for storing an operating software, the function of which will be described below. Further, the unit control circuit 18 comprises memory to store data, namely lighting scenario data, as will be further described below.

The unit control circuit 18 is connected to both electrical conductors 12, 14 to be supplied with operating electrical power. It further comprises circuitry (not shown) to determine a voltage level of an operating voltage V between the conductors.

The lighting element 16 is connected to the unit control circuit 18 such that its operating current I is controlled by the unit control circuit 18. In the preferred embodiment, the unit control circuit 18 can turn the operating current I on and off, which enables control by PWM. While in FIG. 1 only one connection is shown, the unit control circuit 18 is connected to the lighting element 16 to control operation of each individual LED separately.

In operation of the lighting unit 10, operating voltage V of a magnitude sufficient to operate the lighting element 16, e. g. 7.5 V, is supplied between the electrical conductors 12, 14. The unit control circuit 18 controls the lighting element 16 according to a pre-stored lighting scenario. A lighting scenario is stored as scenario data in the internal memory of the unit control circuit 18 describing a sequence of operation of the lighting element 16, i. e. time-dependent settings for intensity and color.

Figure 2:
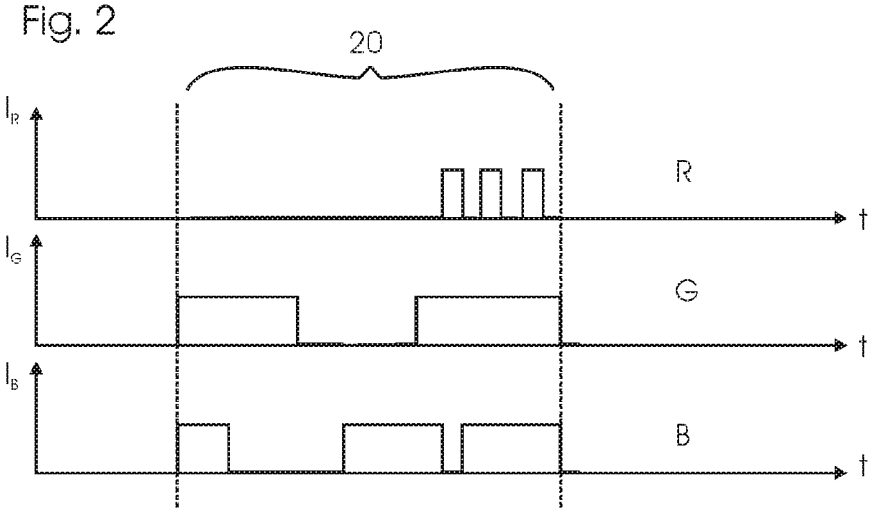
FIG. 2 is a timing diagram as an example of a lighting scenario.

FIG. 2 shows a timing diagram of an example of a lighting scenario 20. The individual current values IR, IG, IB for the red, green and blue LEDs are shown over time t. As shown, the LEDs of the lighting element 16 are turned on or off at specified times and for specified durations, or may be operated in a dimmed manner by pulse width modulation. The resulting light output of the lighting element 16 operated according to the lighting scenario 20 is consequently of varying color and intensity over time t. It should be understood that the scenario 20 is merely an example demonstrating the nature of scenario data, whereas in practical embodiments different scenarios may be used, both of constant and/or varying color.

Figure 3:
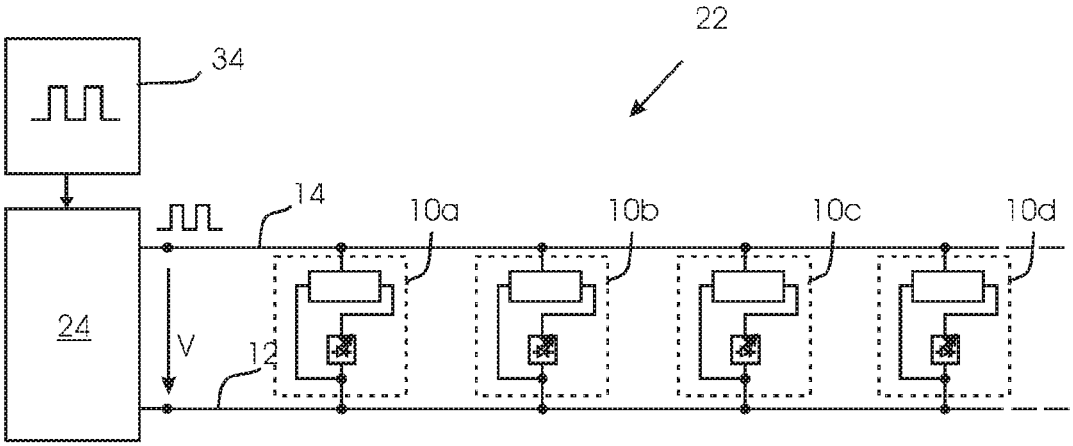
FIG. 3 is a schematic diagram of a first embodiment of a lighting system with multiple lighting units and a modulation means.

FIG. 3 shows a first embodiment of a lighting system 22 with a number of lighting units 10*a*-10*d*, each configured as described above for lighting unit 10, electrically connected in parallel between the conductors 12, 14. The lighting units 10*a*-10*d* are arranged in a string configuration, i. e. spaced along a line and connected by the conductors 12, 14.

An operating voltage V is applied to the conductors 12, 14 by a power source 24. The power source 24 thus supplies electrical operating power to the lighting units 10*a*-10*d* for operation of the unit control circuits 18 and of the lighting elements 16. While it may be possible to implement linear control of the current in each lighting unit, this could lead to increased losses. Therefore, it is preferred to provide control of the total current supplied by the power source 24 to the lighting units 10*a*-10*d* in each instant according to the presently required total current.

In addition to supplying electrical operating power, the power source 24 is in the present example also used to communicate with the lighting units 10*a*-10*d*. A system control circuit 34 controls the power source 24 to modulate the operating voltage V. By way of modulation of the operating voltage V, data may be transmitted from the system control circuit 34 to the lighting units 10*a*-10*d*.

One type of data to be transmitted from the system control circuit 34 is an execute signal, causing one or more of the lighting units 10*a*, 10*d* to execute a pre-stored scenario 20, i. e. to operate the lighting elements 16 according to the stored sequence of settings corresponding to the scenario data. The execute command may include an address of one or more of the lighting units 10*a*-10*d* to specify which lighting unit is supposed to apply the pre-stored scenario. If multiple lighting scenarios are stored in the unit control circuit 18, the execute command may select which of the pre-stored lighting scenarios should be executed by the addressed lighting units 10*a*-10*d*.

Figure 5:
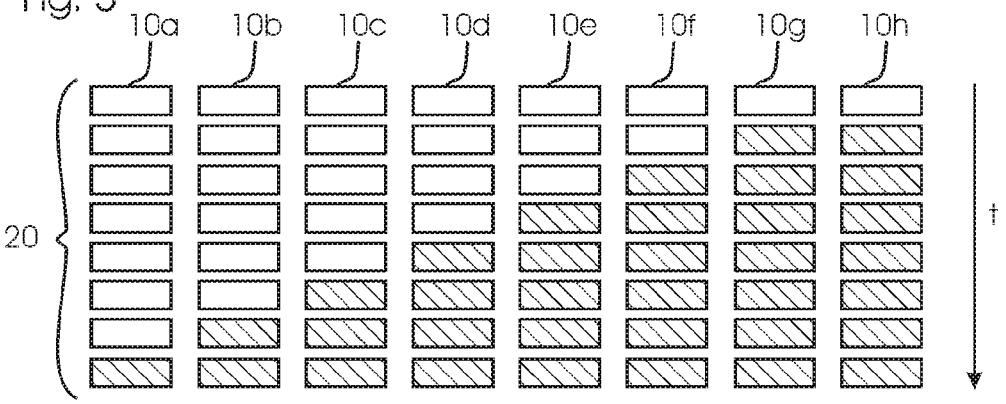
FIGS. 5 and 6 are diagrams showing examples of display patterns.

FIG. 5 shows a first example of a display pattern that may be achieved by using pre-stored scenarios. In the example eight lighting units 10*a*-10*h* are provided in a string configuration. In the diagram of FIG. 5, the lighting units 10*a*-10*h* are shown over time t from top to bottom. Activated lighting units, i. e. with lighting elements 16 emitting light, are shown hatched.

At first, all lighting units 10*a*-10*h* are deactivated (first row in FIG. 5). Progressing over time t, first the two lighting units 10*g*, 10*h* to the right are activated, then three lighting units 10*f*, 10*g*, 10*h*, then four lighting units 10*e*, 10*f*, 10*g*, 10*h*, etc. The resulting display pattern progresses from right to left over time t. Lighting units 10*a*-10*h* may e.g. constitute a turn signal unit for a motor vehicle. The display pattern may then constitute a progressive turn signal showing the direction of a planned turn (to the left in the example of FIG. 5).

The display pattern illustrated in FIG. 5 is the result of eight individual lighting scenarios stored in the lighting units 10*a*-10*h*. An example of a lighting scenario 20 is shown for the first lighting unit 10*a* which is deactivated during the first seven cycles and activated only in the last cycle. In contrast, the lighting unit 10*h* is deactivated only in the first cycle and activated in all remaining cycles.

Display of the pattern illustrated in FIG. 5 may thus be achieved by pre-storing the individual scenarios in the lighting units 10*a*-10*h* and sending a common execute signal, causing each lighting unit to execute its pre-stored scenario over the seven cycles shown.

Figure 6:
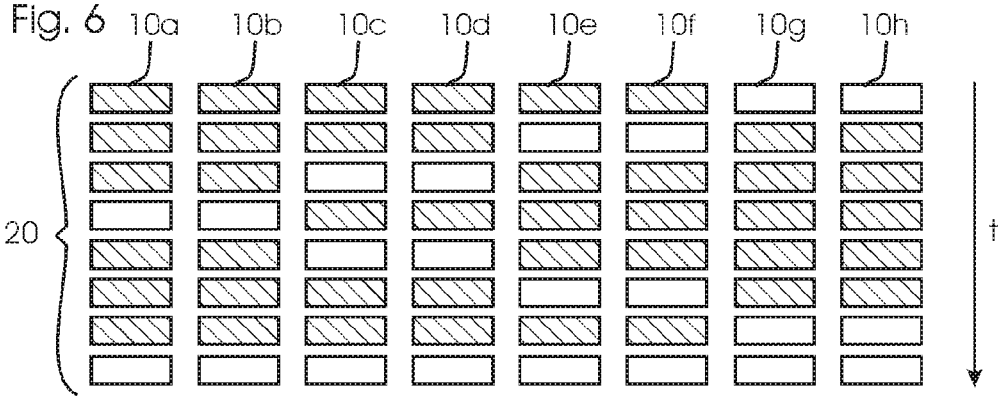

FIG. 6 shows a second example of a display pattern, which could for example also be used for a turn signal light of a motor vehicle, or alternatively for another signal light of a motor vehicle, e.g. a daytime running light DRL or a position light. The sequence shown may e.g. be a welcome light shown as the motor vehicle is unlocked. Again, individual lighting scenarios 20 pre-stored in the lighting units 10*a*-10*h* are executed by sending an execute signal to all lighting units 10*a*-10*h* to show the display pattern of FIG. 6.

It should be noted that, as the individual lighting scenarios 20 are pre-stored in the lighting units 10*a*-10*h* and only one common execute signal needs to be transmitted from the system control circuit 34 to the lighting units, the required bandwidth is very low.

Figure 4:
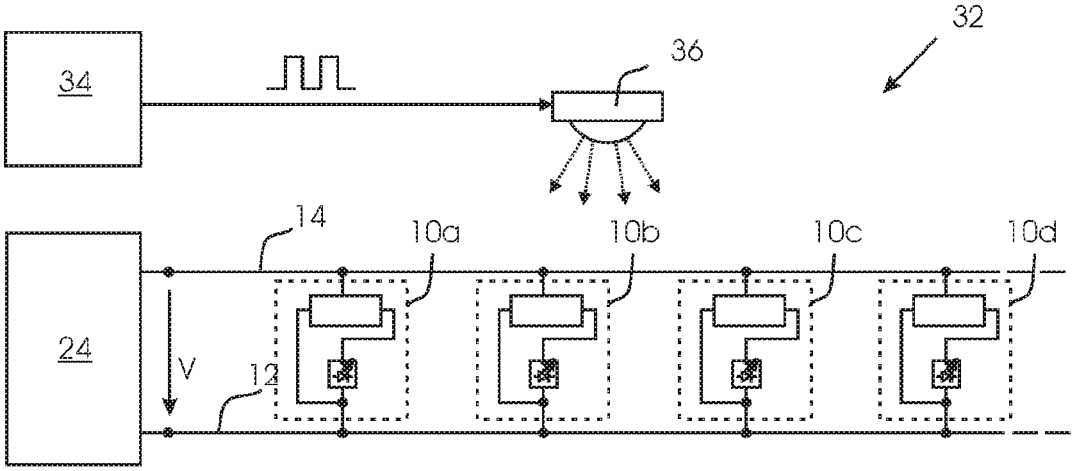
FIG. 4 is a schematic diagram of a second embodiment of a lighting system with multiple lighting units and a modulated light source.

FIG. 4 shows a second embodiment of a lighting system 32 with multiple lighting units 10*a*-10*d*. The second embodiment of a lighting system 32 corresponds in many elements to the first embodiment of a lighting system 22. Like reference numbers refer to like parts. In the following, only differences will be further explained.

In the lighting system 32, the system control circuit 34 is connected to a light source 36 which may be controlled to emit modulated light. In this embodiment, the LEDs of the lighting element 16 in the lighting unit 10*a*-10*d* are operated as light sensors by the unit control circuits 18. In this way, data, such as an execute signal, is transmitted from the system control circuit 34 to the lighting units 10*a*-10*d*.

There are different possible ways to set up the lighting systems 22, 32 for operation as described above. For programming the scenario data in the local storage of each lighting unit, the data may be transmitted from a programming device. For example, the lighting units may be provided with individual addresses, so that data—e.g. as modulated light or through modulation of the supply voltage V—may be transferred individually to the lighting units to be stored as scenario data.

Individual addresses of the lighting units 10*a*-10*d* may e.g. be achieved by hardware coding, e.g. by providing coding resistors. Further, it is possible to use a laser to connect, disconnect and/or change a coding element on each of the lighting units 10*a*-10*d* which is then read out by the unit control circuit 18 to establish an address.

Figure 7:
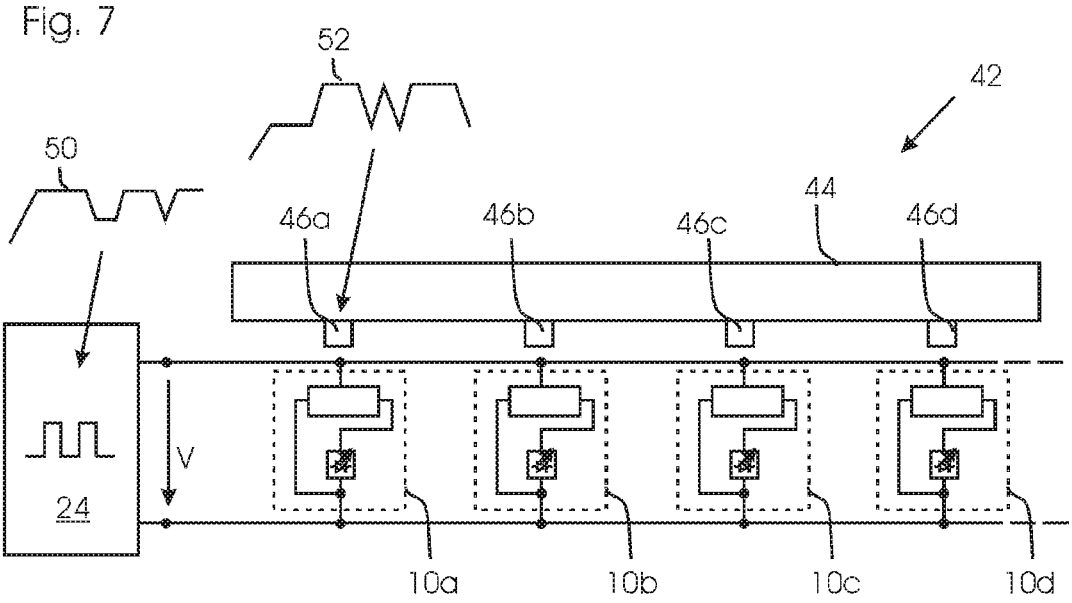
FIG. 7 shows a fourth example of a lighting system with a programming light source.

Preferably, addressing may be provided by in-circuit programming using modulated light. FIG. 7 shows a fourth embodiment of a lighting system 42 with four lighting units 10*a*-10*d* connected to an electrical power supply 24. A programming light source 44 may be placed above the strip of lighting units 10*a*-10*d*. The programming light source 44 has individually controllable lighting elements 46*a*-46*d*, each associated with and placed adjacent to one of the lighting units 10*a*-10*d*. Programming signal 50 may be send as a modulated supply voltage V to set the lighting units

10*a*-10*d* into a programming mode. A sequence of modulated light 52 may then be sent by the lighting elements 46*a*-46*d* of the programming light source 44 to be received by the lighting elements 16 of the lighting units 10*a*-10*d* acting as sensors to receive scenario data. The scenario data is stored in the local storage of the unit control circuit 18.

For communication, both by a programming device and by a system control circuit with the lighting units 10*a*-10*d* via modulation of the voltage V, different modulation schemes may be used. Preferred embodiments of modulation sequences are shown in FIGS. 8A-8C.

Figure 8A:
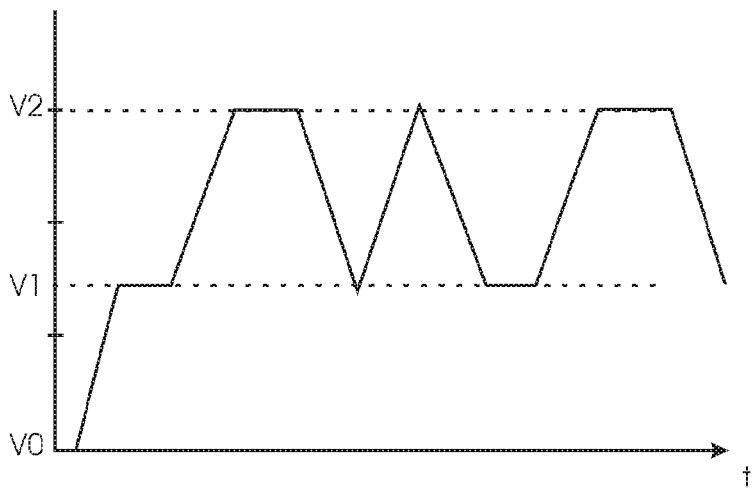
FIGS. 8A-8C show diagrams of modulation sequences.
Figure 8B:
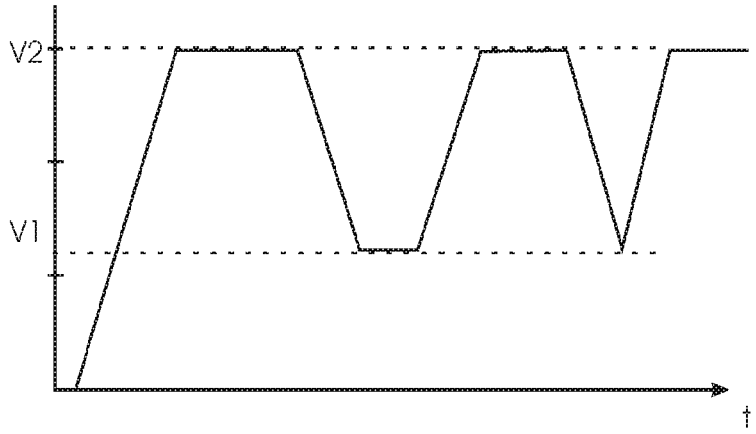
Figure 8C:
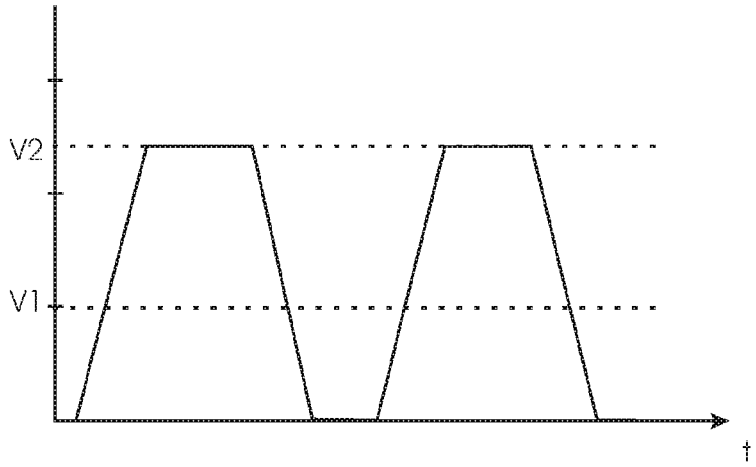

FIG. 8A shows an example using three different voltage levels V0, V1 and V2. The voltage level V2 may correspond to a logic high and be sufficient of the lighting element 16 in each lighting unit 10 to operate. For example, the voltage level V2 may be 7.5 V. The voltage level V1, e.g. corresponding to a logical low, is lower than the voltage level V2, but still sufficient for the unit control circuit 18 to operate, e. g. at 3 V.

Data may then be encoded by a modulation as shown in the example by the supply voltage V varying between voltage levels V1 and V2, rendering the unit control circuits 18 of all connected lighting units operational throughout the entire time t to decode the sequence. This type of communication may both be used for transmission of an execute signal and for programming of scenario data. A specific sequence of variations between the voltage levels may e.g. include encoded data, for example to identify one of several pre-stored scenarios to execute.

In alternative communication schemes, further different voltage levels both above and below V1 and V2 may be used for encoding and transmitting data, e.g. as a learning signal to announce scenario data to store, or as execute signal to start a specific pre-stored scenario.

If communication needs to occur while the lighting units 10 remain activated, modulation may be effected as shown in the example of FIG. 8B, i. e. by keeping the supply voltage at the voltage level V2 required for operation of the lighting element 16 with only very short interruptions during which the voltage V is reduced to level V1, still sufficient to keep the unit control circuit 18 operational. If interruptions are short enough, they will not be visible to the human eye.

FIGS. 8A-8C show an example of a fallback solution, e. g. to cause the lighting system to emit an emergency flash, where all lighting units are directly activated. This may e.g. be achieved by switching on directly to the voltage level V2, skipping the intermediate voltage V1.

While the invention has thus been illustrated and described in detail in the drawings and the foregoing description, such illustration and description are to be considered illustrative or exemplary and not restrictive; the invention is not limited to the disclosed embodiments.

For example, the number and special configuration of the lighting units 10 in the lighting system may be chosen as required for a given requirement. Instead of RGB multicolor LEDs as described, the lighting units may have LEDs of a single color, or other color configurations such as e.g. RGBW (red, green, blue, and converted white). Further, other types of light sources emitting e.g. infrared or ultraviolet light may be used. Also, the type of modulation used may be freely chosen without being limited by the given examples. While the unit control circuit 18 has been described as an integrated circuit it is alternatively possible to use an electrical circuit of discrete components fulfilling the described function.

Further variations to the disclosed embodiments can be understood and effected by those skilled in the art in practicing the claimed invention, from a study of the drawings, the disclosure and the dependent claims. In the claims, the word "comprising" does not exclude other elements and steps, and the indefinite article ("a" or "an") does not exclude a plurality. The mere fact that certain measures are recited in mutually different dependent claims or different embodiments does not indicate that a combination of these measures cannot be used to advantage. Any reference signs in the claims should not be construed as limiting the scope.

What is claimed is:

1. A lighting system, comprising:

a plurality of lighting units, each of the plurality of lighting units comprising a unit control circuit and a lighting element, each unit control circuit comprising a memory that stores at least one lighting scenario, each of the at least one lighting scenario comprising a succession of settings of at least one of intensity of the lighting element and color of the lighting element; and a system control circuit comprising a transmitter configured to transmit an execute signal to the plurality of lighting units that includes an indication of one or more of the plurality of lighting units that is to operate the lighting element according to the at least one lighting scenario, wherein the plurality of lighting units are electrically connected in parallel to a common electrical power supply via two conductors, wherein the execute signal is transmitted at least one of wirelessly and via the two conductors from the system control circuit to the plurality of lighting units.

2. The lighting system according to claim 1, wherein a programming device is provided to transmit scenario data for the lighting scenario to at least one of the plurality of lighting units, wherein each unit control circuit is disposed to receive and store the scenario data, and the scenario data being transmitted at least one of wirelessly or via the two conductors.

3. The lighting system according to claim 2, wherein the programming device is disposed to transmit a programming signal sequence to one or more of the plurality lighting units, and each unit control circuit is disposed to receive and store the scenario data upon reception of the programming signal sequence.

4. The lighting system according to claim 2, wherein at least one of the execute signal and the scenario data are transmitted by transmitter means comprising at least one light source disposed to transmit at least one of the scenario data and the execute signal by modulated light, and wherein the plurality of lighting units comprise a light sensor, each unit control circuit being disposed to process a signal received from the light sensor upon reception of the modulated light to receive at least one of the scenario data and the execute signal.

5. The lighting system according to claim 4, wherein each lighting elements of the plurality of lighting units comprise at least one LED element, and the at least one LED element is used as the light sensor.

6. The lighting system according to claim 2, wherein at least one of the execute signal and the scenario data are transmitted by modulating means disposed to modulate electrical power supplied from the electrical power supply to the two conductors, and each unit control circuit being connected to the two conductors and disposed to process a modulated electrical signal at the conductors to receive at least one of the execute signal and the scenario data.

7. The lighting system according to claim 6, wherein the modulating means are disposed to modulate the electrical power using at least a first voltage level sufficient for operation of each unit control circuit but not sufficient for operation of each lighting element.

8. The lighting unit according to claim 7, wherein the modulating means are disposed to modulate the electrical power using a second voltage level sufficient for operation of each lighting element.

9. The lighting system according to claim 1, wherein each unit control circuit is disposed to store a plurality of lighting scenarios, and upon reception of an execute signal associated with one of the plurality of stored lighting scenarios operate each lighting element according to the lighting scenario.

10. The lighting system according to claim 1, wherein each of the at least one lighting scenarios comprises a plurality of settings, and wherein each of the plurality of settings comprise at least one of an intensity of light and a color of light to emitted from each of the plurality of lighting units, and a display time during which each of the plurality of lighting units is operated according to said setting.

11. The lighting system according to claim 1, wherein each of the plurality of lighting units are arranged in a string configuration, wherein each of the plurality of lighting units are arranged spaced along a line and connected by the two conductors.

12. A method of operating a lighting system, including a plurality of lighting units, each of the plurality of lighting units including a unit control circuit and a lighting element, each of the plurality of lighting units being electrically connected in parallel to a common electrical power supply via two conductors, the method comprising:

storing at least one lighting scenario within each of the plurality of lighting units, the at least one lighting scenario comprising a succession of settings of at least one of an intensity of the lighting element and a color of the lighting element;

transmitting an execute signal to one or more of the ouch of the plurality of lighting units, the execute signal being transmitted at least one of wirelessly or via the two conductors; and in response to receiving the execute signal by each of the plurality of lighting units, controlling each lighting element according to the lighting scenario.

* * * * *